US006278243B1

(12) United States Patent
Yoo

(10) Patent No.: US 6,278,243 B1
(45) Date of Patent: Aug. 21, 2001

(54) ELECTRODE DIVISION SURFACE DISCHARGE PLASMA DISPLAY APPARATUS

(75) Inventor: Ji-seung Yoo, Yongin (KR)

(73) Assignee: Samsung SDI Co., Ltd., Suwon (KR)

( * ) Notice: Subject to any disclaimer, the term of this patent is extended or adjusted under 35 U.S.C. 154(b) by 0 days.

(21) Appl. No.: 09/644,051

(22) Filed: Aug. 23, 2000

(30) Foreign Application Priority Data

Oct. 18, 1999 (KR) ..... 99-45044

(51) Int. Cl.[7] ..... G09G 3/10
(52) U.S. Cl. ..... 315/169.4; 345/63
(58) Field of Search ..... 315/169.4, 169.1, 315/169.2; 345/60, 63, 68, 147

(56) References Cited

U.S. PATENT DOCUMENTS

| | | | | |
|---|---|---|---|---|
| Re. 37,083 | * | 3/2001 | Kanazawa | 315/169.4 |
| 5,436,634 | * | 7/1995 | Kanazawa | 345/60 |
| 5,973,655 | * | 10/1999 | Fujizaki et al. | 345/147 |
| 6,091,380 | * | 7/2000 | Hashimoto et al. | 345/60 |
| 6,140,984 | * | 10/2000 | Kanazawa et al. | 315/169.4 |
| 6,222,512 | * | 4/2001 | Tajima et al. | 345/63 |

* cited by examiner

*Primary Examiner*—Don Wong
*Assistant Examiner*—Thuy Vinh Tran
(74) *Attorney, Agent, or Firm*—Leydig, Voit & Mayer, Ltd.

(57) ABSTRACT

A surface discharge plasma display apparatus has first and second substrates separated and opposed to each other. X-electrode lines, Y-electrode lines, and address electrode lines are arranged between the first and second substrates. The X-electrode lines are parallel to the Y-electrode lines, and the address electrode lines are orthogonal to the X-electrode lines and the Y-electrode lines. Pixels are defined at intersections of address and X and Y-electrode lines. A scan drive signal is applied to each of the Y-electrode lines while display data signals are being applied to the address electrode lines, forming wall charges in selected pixels. An alternating current voltage is applied to each of the X-electrode lines and each of the Y-electrode lines after the wall charges are formed in the selected pixels, causing light to be emitted from the selected pixels. Each Y-electrode line is divided into a left Y-electrode line and a right Y-electrode line. A left Y-driver generates a drive signal for left terminals of the left Y-electrode lines, and a right Y-driver generates a drive signal for right terminals of the right Y-electrode line. The left and right Y-electrode drivers operate in response to the same control signal.

4 Claims, 7 Drawing Sheets

ELECTRODE DIVISION SURFACE DISCHARGE PLASMA DISPLAY APPARATUS

BACKGROUND OF THE INVENTION

1. Field of the Invention

The present invention relates to a plasma display apparatus, and more particularly, to a surface discharge type triode plasma display apparatus.

2. Description of the Related Art

FIG. 1 shows the structure of a panel of a surface discharge type triode plasma display apparatus. FIG. 2 shows an electrode line pattern of the plasma display panel shown in FIG. 1. FIG. 3 shows another view of one pixel in the plasma display panel of FIG. 1. Referring to the drawings, address electrode lines $A_1, A_2, \ldots, A_{m-1}$ and $A_m$, dielectric layers 11 and 15, Y-electrode lines $Y_1, \ldots$, and $Y_n$, X-electrode lines $X_1, \ldots$, and $X_n$, phosphors 16, partition walls 17, and a magnesium oxide (MgO) layer 12 as a protective layer are provided between front and rear glass substrates 10 and 13 of a general surface discharge plasma display panel 1.

The address electrode lines $A_1, A_2, \ldots, A_{m-1}$ and $A_m$ are formed on the front surface of the rear glass substrate 13 in a predetermined pattern. A lower dielectric layer 15 is deposited on the entire front surfaces of the address electrode lines $A_1, A_2, \ldots, A_{m-1}$ and $A_m$. The partition walls 17 are formed on the front surface of the lower dielectric layer 15 perpendicular to the address electrode lines $A_1, A_2, \ldots, A_{m-1}$and $A_m$. These partition walls 17 define the discharge areas of pixels and serve to prevent cross talk between pixels. Each phosphor 16 is deposited between partition walls 17.

The X-electrode lines $X_1, \ldots$, and $X_n$ and the Y-electrode lines $Y_1, \ldots$, and $Y_n$ are formed on the rear surface of the front glass substrate 10 in a predetermined pattern to be perpendicular to the address electrode lines $A_1, A_2, \ldots, A_{m-1}$ and $A_m$. The respective intersections define pixels. Each of the X-electrode lines $X_1, \ldots$, and $X_n$ is composed of a transparent conductive indium tin oxide (ITO) electrode line $X_{na}$ (FIG. 3) and a metal bus electrode line $X_{nb}$ (FIG. 3). Each of the Y-electrode lines $Y_1, \ldots$, and $Y_n$ is composed of an ITO electrode line $Y_{na}$ (FIG. 3) and a metal bus electrode line $Y_{nb}$ (FIG. 3). The upper dielectric layer 11 is deposited on the entire rear surfaces of the X-electrode lines $X_1, \ldots$, and $X_n$ and the Y-electrode lines $Y_1, \ldots$, and $Y_n$. The MgO layer 12 for protecting the panel 1 against a strong electrical field is deposited on the entire surface of the upper dielectric layer 11. A gas for forming plasma is hermetically sealed in a discharge space 14.

A driving method fundamentally adopted for such a plasma display panel as described above is to sequentially perform a reset step, an address step and a sustain-discharge step in a unit sub-field. In the reset step, residual wall charges in the previous sub-field are removed, and space charges are uniformly generated. In the address step, wall charges are produced at selected pixels. In the sustain-discharge step, light is emitted from pixels at which the wall charges are formed in the address step. In other words, when an alternating current (AC) pulse of a relatively high voltage is applied between the X-electrode lines $X_1, \ldots$, and $X_n$ and the Y-electrode lines $Y_1, \ldots$, and $Y_n$, surface discharges occur at the pixels at which the wall charges are formed. At this time, a plasma is formed in a gas layer, and the phosphors 16 are excited due to irradiation by ultraviolet rays from the plasma, thereby generating light.

In such a plasma display apparatus, conventionally, a single Y-driver applies a driving signal to only one end of each of the Y-electrode lines $Y_1$ through $Y_n$.

FIG. 4 illustrates a conventional triode surface discharge plasma display apparatus. Referring to FIG. 4, the conventional triode surface discharge plasma display apparatus includes a display panel 2, a controller 21, an address driver 22, a Y-driver 231 and 232 and an X-common driver 24. The controller 21 includes a display data controller 211 and a drive controller 212. The display data controller 211 includes a frame memory 201, and the drive controller 212 includes a scan controller 202 and a common controller 203. The Y-driver 231 and 232 includes a scan driver 231 and a Y-common driver 232.

The controller 21 receives a clock signal CLK, a data signal DATA, a vertical synchronizing signal $V_{SYNC}$ and a horizontal synchronizing signal $H_{SYNC}$ from a host, for example, a notebook computer. The display data controller 211 stores the data signal DATA in the internal frame memory 201 in response to the clock signal CLK, and applies a corresponding address control signal to the address driver 22. The drive controller 212 including the scan controller 202 and the common controller 203 processes the vertical synchronizing signal $V_{SYNC}$ and the horizontal synchronizing signal $H_{SYNC}$. The scan controller 202 generates signals for controlling the scan driver 231, and the common controller 203 generates signals for controlling the Y-common driver 232 and the X-common driver 24.

The address driver 22 processes the address control signal from the display data controller 211 and applies corresponding display data signals to the address electrode lines $A_1, A_2, \ldots$, and $A_m$ of the display panel 2 in an address step. The scan driver 231 of the Y-driver 231 and 232 applies a corresponding scan drive signal to each Y-electrode line $Y_1, Y_2, \ldots$, or $Y_n$ in response to a control signal from the scan controller 202 in the address step. The Y-common driver 232 of the Y-driver 231 and 232 simultaneously applies a common drive signal to each of the Y-electrode lines $Y_1$ through $Y_n$, in response to a control signal from the common controller 203 in a sustain-discharge step. The X-common driver 24 simultaneously applies a common drive signal to each of the X-electrode lines $X_1$ through $X_n$ in response to a control signal from the common controller 203 in the sustain-discharge step.

As described above, a conventional surface discharge plasma display apparatus is designed such that the single Y-driver 231 and 232 applies a drive signal to the one end of each Y-electrode line $Y_1, Y_2, \ldots$, or $Y_n$. In relation to this fact, a problem of such a conventional surface discharge plasma display apparatus will be described below with reference to FIG. 5.

FIG. 5 illustrates the operation of the plasma display apparatus of FIG. 4 in an address step. In FIG. 5, reference characters $C_{11}$ through $C_{nm}$ indicate pixels corresponding to the intersections of address electrode lines $A_1$ through $A_m$ and display electrode lines $Y_1$ through $Y_n$ and $X_1$ through $X_n$. Reference characters $R_1$ through $R_m$ indicate resistance values in unit areas of each Y-electrode line $Y_1, Y_2, \ldots$, or $Y_n$.

Referring to FIG. 5, the left terminal of each Y-electrode line $Y_1, Y_2, \ldots$, or $Y_n$ in the plasma display panel 2 is connected to a corresponding output terminal in the scan driver 231. Each output terminal of the scan driver 231 is connected to one of upper totem-pole transistors $UTP_1$, through $UTP_n$ and one of lower totem-pole transistors $LTP_1$, through $LTP_n$. In the address driving step performed in a unit sub-field, the address driver 22 simultaneously applies display data signals corresponding to a scanned Y-electrode line (one of the Y-electrode lines $Y_1$. through $Y_n$) to all the address electrode lines $A_1$, through $A_m$. Here, a positive voltage higher than a ground voltage is applied to address electrode lines corresponding to pixels to be displayed, and a ground voltage is applied to address electrode lines corresponding to pixels not to be displayed.

In the address driving step performed in a unit sub-field, a lower totem-pole transistor connected to a output terminal of the scan driver 231, which is connected to a scanned Y-electrode line, is turned on, and an upper totem-pole transistor connected to the output terminal is turned off, in order to satisfy the condition that a first negative voltage−Vy lower than the ground voltage is applied to a scanned Y-electrode line (one of the Y-electrode lines $Y_1$ through $Y_n$) On the other hand, upper totem-pole transistors connected to output terminals of the scan driver 231, which are connected to unscanned Y-electrode lines, are turned on, and the lower totem-pole transistors connected to the output terminals are turned off, in order to satisfy the condition that a second negative voltage−Vsc higher than the first negative voltage−Vy and lower than the ground voltage is applied to unscanned Y-electrode lines (all the Y-electrode lines $Y_1$ through $Y_n$ except one). Meanwhile, ground potential or a positive voltage a little higher than the ground potential is applied from the X-common driver 24 to the X-electrode lines $X_1$, through $X_n$ which do not operate in the address driving step.

If it is assumed that the first Y-electrode line $Y_1$ is scanned due to the application of the first negative voltage−Vy so that pixels $C_{11}$, $C_{12}$ and $C_4$ are turned on, and a pixel $C_{13}$ is turned off, a voltage $V_{C14}$ obtained at the location of the pixel $C_{14}$ is determined in accordance with Equation (1).

$$V_{14}=-Vy+R_1\cdot I_1+(R_1+R_2)\cdot I_2+(R_1+R_2+R_3+R_4)\cdot I_4 \quad (1)$$

As the distance from the position where the first negative voltage−Vy is applied increases, the first negative voltage−Vy increases due to voltage drop on each Y electrode line. Accordingly, addressing for pixels far from the position where the first negative voltage−Vy is applied is not exactly performed. This phenomenon is more serious when all pixels on a Y electrode line are ON. In addition, a large current flows in the lower totem-pole transistors $LTP_1$ through $LTP_n$ of the scan driver 231, increasing voltage drop. Large current may damage or destroy the lower totem-pole transistors $LTP_1$, through $LTP_n$.

SUMMARY OF THE INVENTION

To solve the above problems, an object of the present invention is to provide a surface discharge plasma display apparatus for exact addressing and decreasing the influence of voltage on an electrode driver.

To achieve the above object, the present invention provides a surface discharge plasma display apparatus having first and second substrates to be separated and opposed to each other. X-electrode line, Y-electrode lines and address electrode lines are arranged between the first and second substrates. The X-electrode lines are arranged in parallel to the Y-electrode lines, and the address electrode lines are arranged to be orthogonal to the X-electrode lines and the Y-electrode lines, thereby defining pixels corresponding to the intersections. A scan drive signal is applied to each of the Y-electrode lines while display data signals are being applied to the address electrode lines, thereby forming wall charges in selected pixels. An alternating current voltage is applied to each of the X-electrode lines and each of the Y-electrode lines after the wall charges are formed in the selected pixels, thereby allowing light to be emitted from the selected pixels. Here, each Y-electrode line is divided into a left Y-electrode line and a right Y-electrode line. A left Y-driver generating a drive signal for the left terminals of the left Y-electrode lines, and a right Y-driver generating a drive signal for the right terminals of the right Y-electrode lines are provided. The left and the right Y-electrode drivers operate in response to the same control signal.

Since each of the Y-electrode lines is divided into the left Y-electrode line and the right Y-electrode line, and the left and right Y-electrode lines are driven by the left and right Y-drivers, respectively, voltage drop on each Y-electrode line decreases so that exact addressing can be performed, and the influence of voltage on a Y driver can be reduced.

BRIEF DESCRIPTION OF THE DRAWINGS

The above object and advantages of the present invention will become more apparent by describing in detail preferred embodiments thereof with reference to the attached drawings in which.

DETAILED DESCRIPTION OF THE INVENTION

Figure 1:
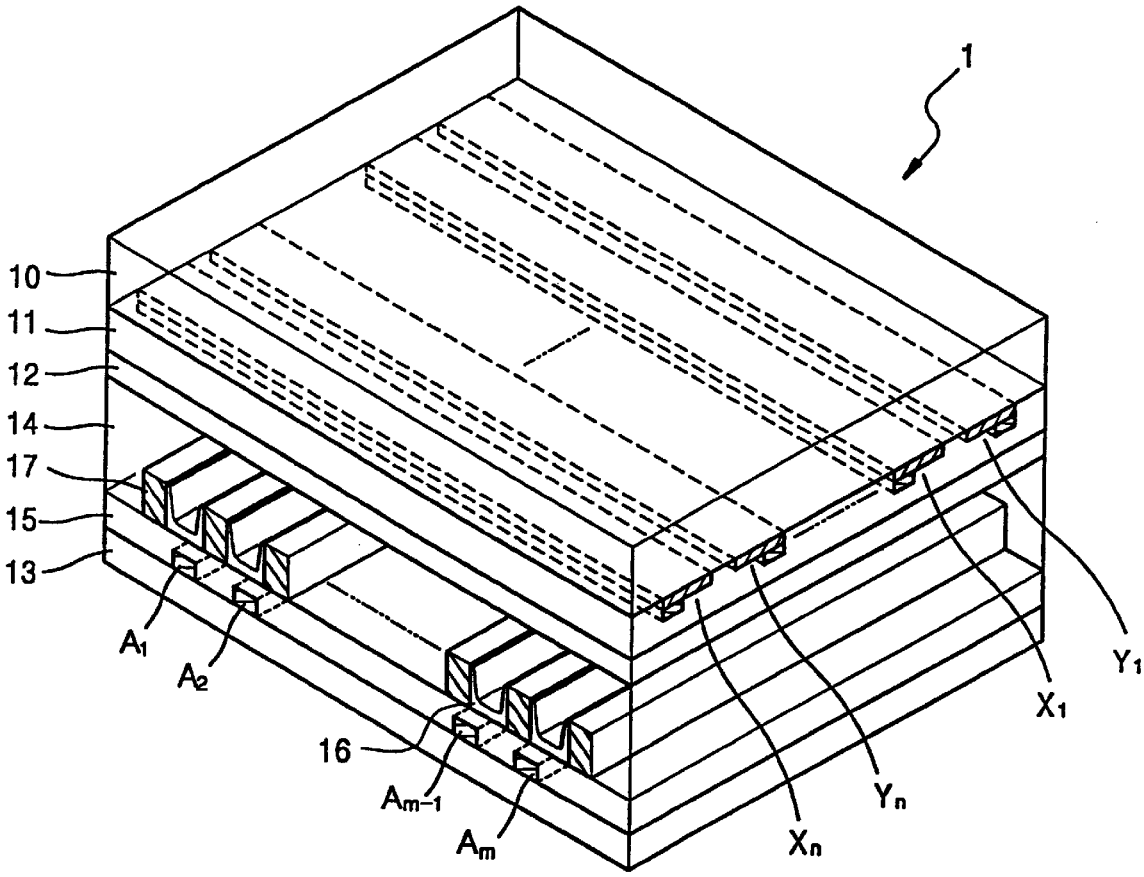
FIG. 1 PRIOR ART
FIG. 1 is an internal perspective view illustrating the structure of a panel of a triode surface discharge plasma display apparatus.
Figure 2:
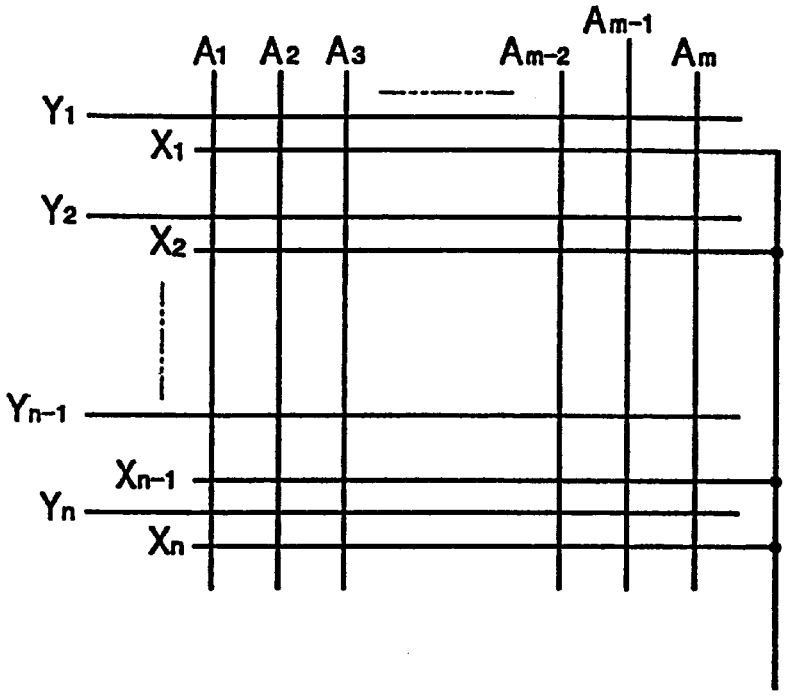
FIG. 2 PRIOR ART
FIG. 2 illustrates an electrode line pattern of the plasma display panel of FIG. 1.
Figure 3:
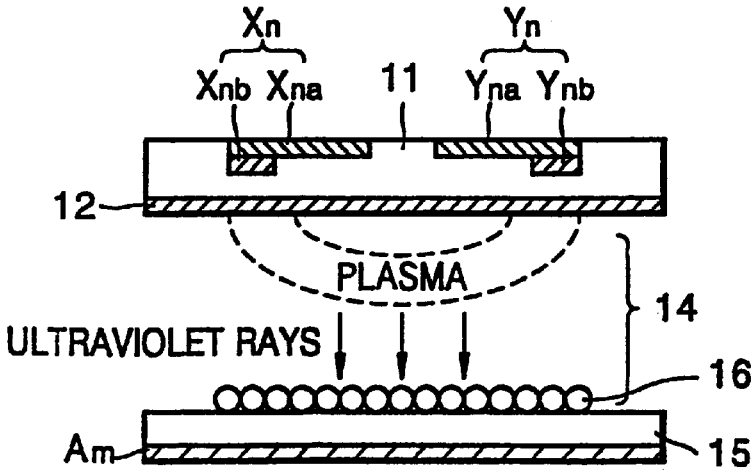
FIG. 3 PRIOR ART
FIG. 3 is a sectional view illustrating an example of one pixel in the plasma display panel of FIG. 1.
Figure 4:
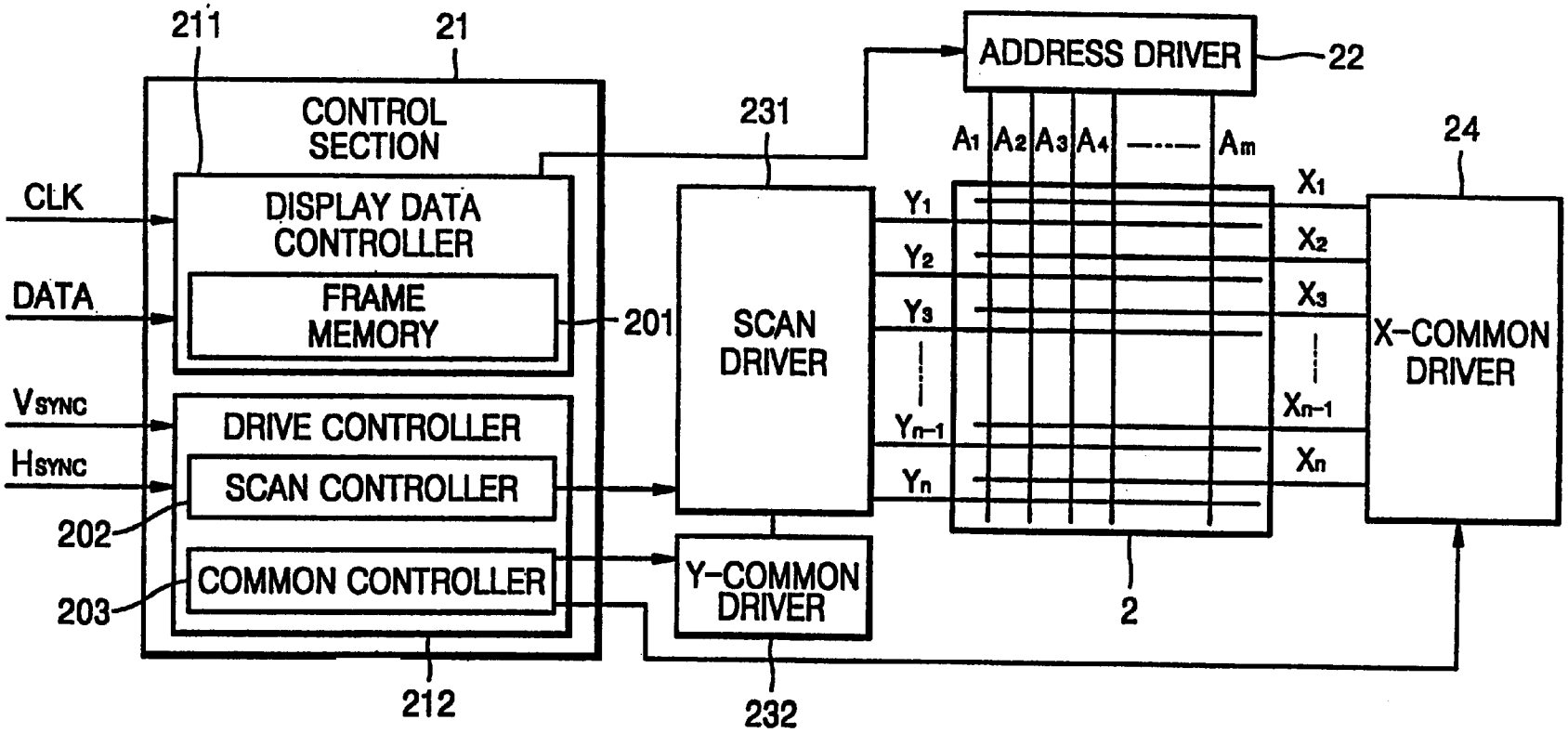
FIG. 4 (PRIOR ART)
FIG. 4 is a schematic diagram illustrating a conventional triode surface discharge plasma display apparatus.
Figure 5:
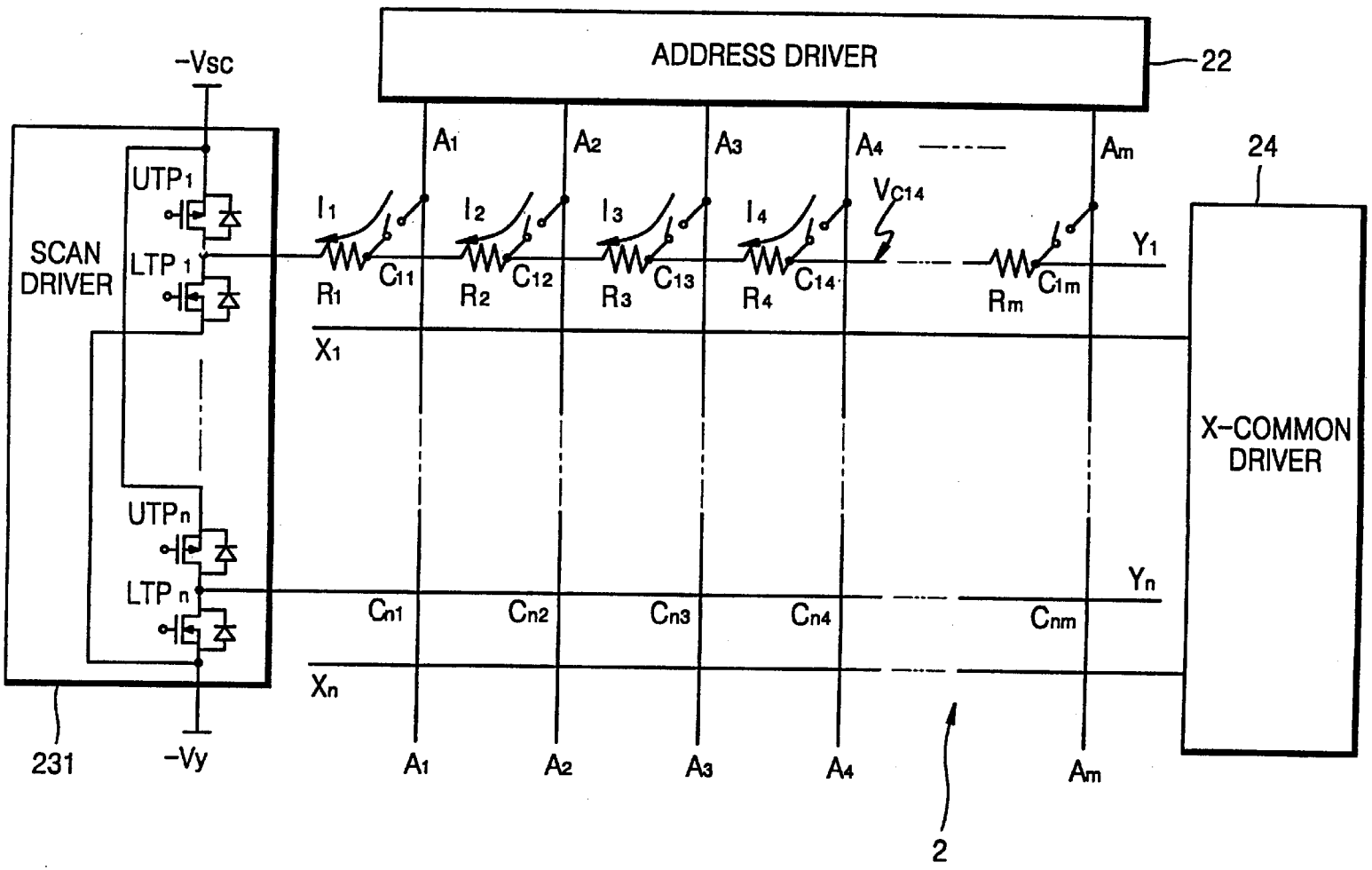
FIG. 5 (PRIOR ART)
FIG. 5 is an equivalent circuit diagram illustrating the operation of the plasma display apparatus of FIG. 4 in an address step.
Figure 6:
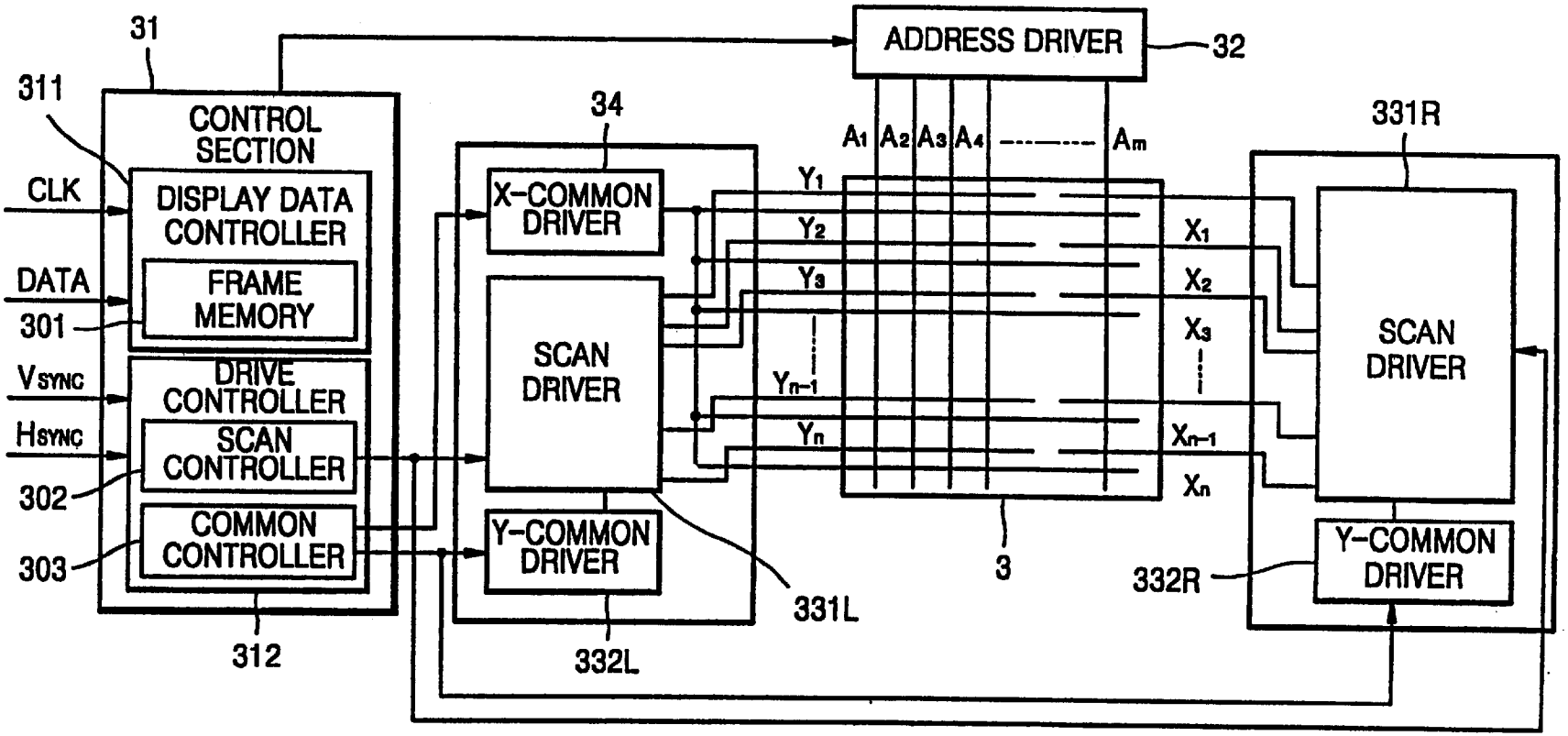
FIG. 6 is a schematic diagram illustrating a triode surface discharge plasma display apparatus according to a first embodiment of the present invention.

Referring to FIG. 6, X-electrode lines $X_1, X_2, \ldots$, and $X_n$, Y-electrode lines $Y_1, Y_2, \ldots$, and $Y_n$, and address electrode lines $A_1, A_2, \ldots$, and $A_m$ are arranged between a first substrate and a second substrate. The X-electrode lines $X_1, X_2, \ldots$, and $X_n$ are parallel to the Y-electrode lines $Y_1, Y_2, \ldots$, and $Y_n$, and the address electrode lines $A_1, A_2, \ldots$, and $A_m$ are perpendicular to the X-electrode lines $X_1, X_2, \ldots$, and $X_n$ and the Y-electrode lines $Y_1, Y_2, \ldots$, and $Y_n$, so that pixels are defined corresponding to the intersections. While display data signals are being applied to the address electrode lines $A_1, A_2, \ldots$, and $A_m$, a scan drive signal is applied to the Y-electrode lines $Y_1, Y_2, \ldots$, and $Y_n$, forming wall charges in selected pixels. After formation of wall charges in the selected pixels, an alternating current (AC) voltage is applied to the X-electrode lines $X_1, X_2, \ldots$, and $X_n$ and the Y-electrode lines $Y_1, Y_2, \ldots$, and $Y_n$ so that light is emitted from the selected pixels. Here, each Y-electrode line is divided into a right portion and a left portion. In addition, a left Y-driver 331L and 332L for generating a drive signal corresponding to the left terminals of the left Y-electrode lines, and a right Y-driver 331R and 332R for generating a drive signal corresponding to the right terminals of the right Y-electrode lines are provided. The right and left Y-drivers operate in response to the same control signal.

The triode surface discharge plasma display apparatus of this embodiment includes a display panel 3, a controller 31, an address driver 32, a Y-driver 331L, 332L, 331 R and 332R, and an X-common driver 34. The controller 31 includes a display data controller 311 and a drive controller 312. The display data controller 311 includes a frame memory 301, and the drive controller 312 includes a scan controller 302 and a common controller 303. The Y-driver 331L, 332L, 331R and 332R includes the left driver 331L and 332L and the right driver 331R and 332R. The left driver 331L and 332L includes a left scan driver 331L and a left Y-common driver 332L. Similarly, the right driver 331R and 332R includes a right scan driver 331R and a right Y-common driver 332R.

The controller 31 receives a clock signal CLK, a data signal DATA, a vertical synchronizing signal $V_{SYNC}$ and a horizontal synchronizing signal $H_{SYNC}$ from a host, for example, a notebook computer. The display data controller 311 stores the data signal DATA in the internal frame memory 301 in response to the clock signal CLK, and applies a corresponding address control signal to the address driver 32. The drive controller 312 including the scan controller 302 and the common controller 303 processes the vertical synchronizing signal $V_{SYNC}$ and the horizontal synchronizing signal $H_{SYNC}$. The scan controller 302 generates signals for simultaneously controlling the left and the right scan drivers 331L and 331R. The common controller 303 generates signals for simultaneously controlling the left and the right Y-common driver 332L and 332R, and also generates signals for controlling the X-common driver 34.

The address driver 32 processes the address control signal from the display data controller 311 and applies corresponding display data signals to the address electrode lines $A_1$, $A_2$, . . . , and $A_m$ of the display panel 3 in an address step.

The left scan driver 331L in the Y-driver 331L, 332L, 331R and 332R sequentially applies a corresponding scan drive signal to the left Y-electrode lines in response to the control signal from the scan controller 302 in the address step. The right scan driver 331R sequentially applies the same scan drive signal as applied by the left scan driver 331L to the right Y-electrode lines.

The left Y-common driver 332L of the Y-driver 331L, 332L, 331R and 332R simultaneously applies a common drive signal to each of the left Y-electrode lines in response to the control signal from the common controller 303 in a sustain-discharge step. The right Y-common driver 332R simultaneously applies the same Y-common drive signal as applied by the left Y-common driver 332L to each of the right Y-electrode lines.

The X-common driver 34 simultaneously applies a common drive signal to each of the X-electrode lines $X_1$ through $X_n$ in response to a control signal from the common controller 303 in the sustain-discharge step.

As described above, by dividing each of the Y-electrode lines $Y_1$ through $Y_n$ into a left portion and a right portion and driving the two portions using the left Y-driver 331L and 332L and the right Y-driver 331R and 332R, respectively, voltage drops on the Y-electrode lines $Y_1$ through $Y_n$ so that exact addressing can be achieved, and the influence of voltage on the Y-driver 331L, 332L, 331R and 332R can be reduced.

Figure 7:
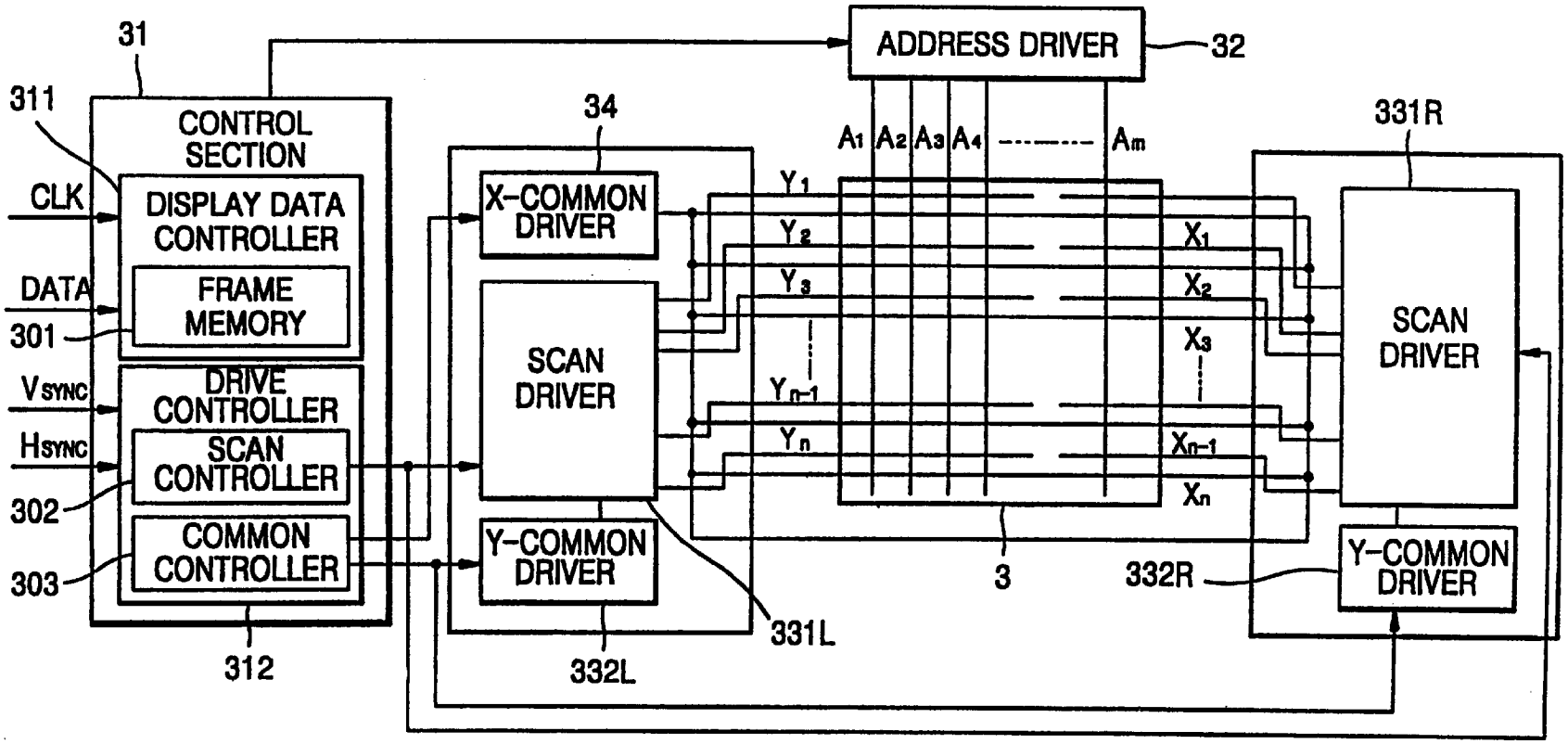
FIG. 7 is a schematic diagram illustrating a triode surface discharge plasma display apparatus according to a second embodiment of the present invention.

FIG. 7 illustrates a triode surface discharge plasma display apparatus according to a second embodiment of the present invention. In FIGS. 6 and 7, the same reference numerals denote the same member having the same function. Unlike the apparatus of FIG. 6, each of the X-electrode lines $X_1$ through $X_n$ is divided into a left portion and a right portion, and the X-common driver 34 simultaneously applies a common drive signal to each of the left and right terminals of the left and right X-electrode lines, in the apparatus of FIG. 7. Accordingly, voltage drop on the X-electrode lines $X_1$ through $X_n$ is reduced so that more exact operation can be performed.

Figure 8:
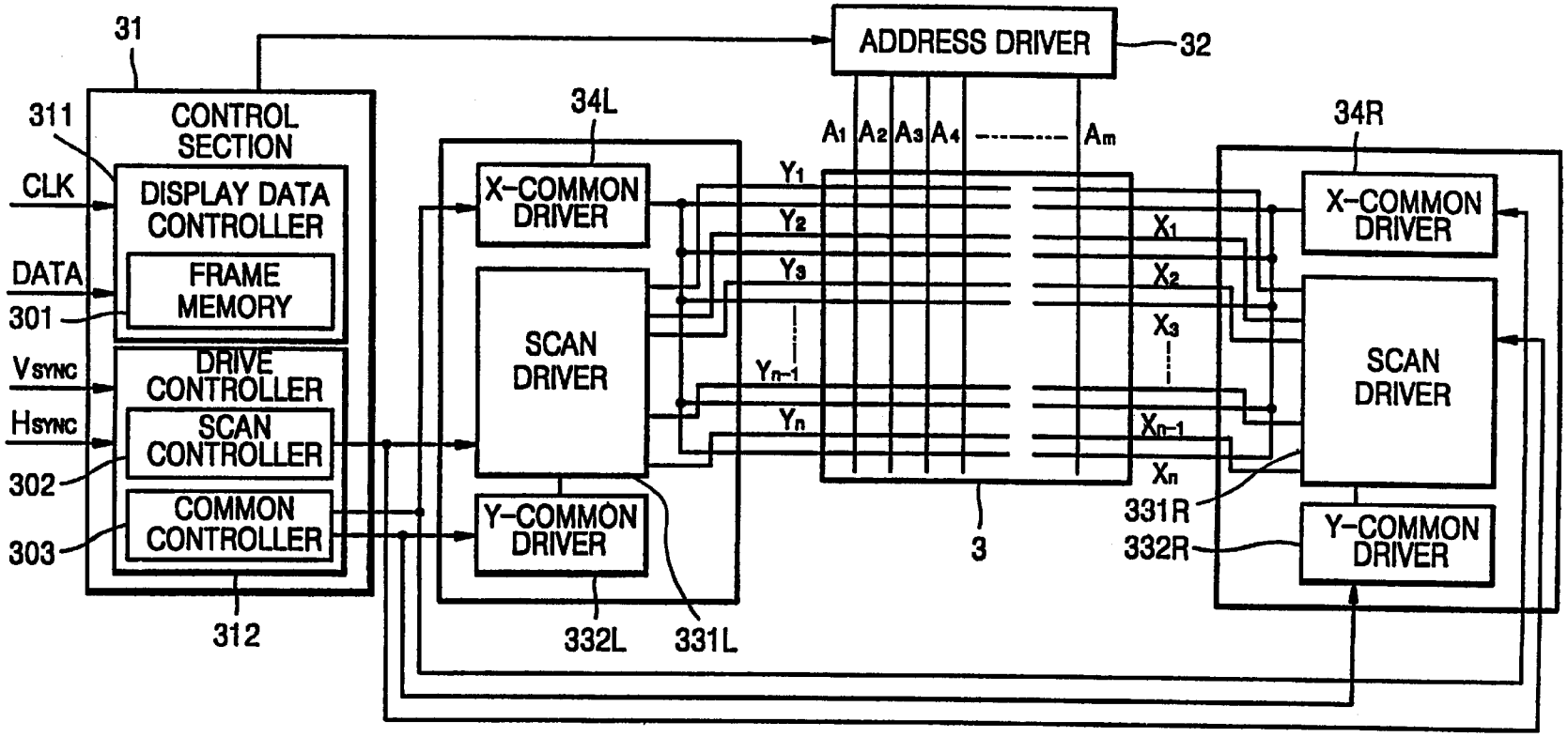
FIG. 8 is a schematic diagram illustrating a triode surface discharge plasma display apparatus according to a third embodiment of the present invention.

FIG. 8 illustrates a triode surface discharge plasma display apparatus according to a third embodiment of the present invention. In FIGS. 7 and 8, the same reference numerals denote the same member having the same function. Unlike the apparatus of FIG. 7 having one X-common driver 34, the apparatus of FIG. 8 includes two X-common drivers 34L and 34R, that is, a left X-common driver 34L and a right X-common driver 34R. The left X-common driver 34L generates a common drive signal for the left terminals of the left X-electrode lines, and simultaneously, the right X-common driver 34R generates a common drive signal for the right terminals of the right X-electrode lines. The left and right X-common drivers 34L and 34R operate in response to the same common control signal from a common controller 312. As described above, by using the left and right X-common drivers 34L and 34R, voltage drop on the X-electrode lines $X_1$ through $X_n$ is reduced, and the influence of voltage on the X-common drivers 34L and 34R can be reduced.

In a plasma display apparatus according to the present invention, each Y-electrode line is divided into a left portion and a right portion, and the left and right portions are driven by a left Y-driver and a right Y-driver, respectively, so that voltage drop on the Y-electrode lines can be reduced. As a result, exact addressing can be performed, and the influence of voltage on a Y-driver can be decreased.

Although the invention has been described with reference to particular embodiments, it will be apparent to one of ordinary skill in the art that modifications of the described embodiments may be made without departing from the spirit and scope of the invention.

What is claimed is:

1. A surface discharge plasma display apparatus having first and second substrates separated and opposed to each other and having X-electrode lines, Y-electrode lines, and address electrode lines between the first and second substrates, the X-electrode lines being parallel to the Y-electrode lines, and the address electrode lines being orthogonal to the X-electrode lines and the Y-electrode lines, pixels being defined at intersections of the address electrode lines and the X-electrode and Y-electrode lines, wherein a scan drive signal is applied to each of the Y-electrode lines while display data signals are applied to the address electrode lines, thereby forming wall charges in selected pixels, and an alternating current voltage is applied to each of the X-electrode lines and each of the Y-electrode lines after the wall charges are formed in the selected pixels, thereby causing light to be emitted from the selected pixels, and each Y-electrode line is divided into a left Y-electrode line having a left terminal and a right Y-electrode line having a right terminal, and a left Y-driver generating a drive signal for the left terminals of the left Y-electrode lines, and a right Y-driver generating a drive signal for the right terminals of the right Y-electrode lines, and the left and right Y-electrode drivers operate in response to the same control signal.

2. The surface discharge plasma display apparatus of claim 1, wherein each of the left and right Y-drivers comprises a scan driver for generating the scan drive signal and a Y-common driver for generating a common drive signal for application of an alternating current.

3. The surface discharge plasma display apparatus of claim 1, wherein each of the X-electrode lines is divided into a left X-electrode line having a left terminal and a right X-electrode line having a right terminal, and a first common drive signal is simultaneously applied to each of the left terminals of the X-electrode lines, and at the same time, a second common drive signal is simultaneously applied to each of the right terminals of the X-electrode lines, the first and second common drive signals being identical.

4. The surface discharge plasma display apparatus of claim 3, further comprising:

a left X-common driver for generating the first common drive signal for each of the left terminals of the left X-electrode lines; and a right X-common driver for generating the second common drive signal for each of the right terminals of the right X-electrode lines, wherein the left and right X-common drivers operate in response to the same drive control signal.

* * * * *